US008347630B2

(12) United States Patent
Lovett et al.

(10) Patent No.: US 8,347,630 B2
(45) Date of Patent: Jan. 8, 2013

(54) AIR-BLAST FUEL-INJECTOR WITH SHIELD-CONE UPSTREAM OF FUEL ORIFICES

(75) Inventors: Jeffery A. Lovett, Tolland, CT (US); Frederick C. Padget, Vernon, CT (US); John W. Mordosky, Manchester, CT (US); Shawn M. McMahon, Manchester, CT (US)

(73) Assignee: United Technologies Corp, Hartford, CT (US)

( * ) Notice: Subject to any disclaimer, the term of this patent is extended or adjusted under 35 U.S.C. 154(b) by 1097 days.

(21) Appl. No.: 12/203,383

(22) Filed: Sep. 3, 2008

(65) Prior Publication Data

US 2010/0050646 A1 Mar. 4, 2010

(51) Int. Cl.
*F02C 1/00* (2006.01)

(52) U.S. Cl. ..... 60/737; 60/740; 60/742; 60/743; 60/748

(58) Field of Classification Search ..... 60/737, 60/740, 742, 748
See application file for complete search history.

(56) References Cited

U.S. PATENT DOCUMENTS

| | | | | |
|---|---|---|---|---|
| 3,703,259 | A * | 11/1972 | Sturgess et al. | 60/748 |
| 3,912,164 | A * | 10/1975 | Lefebvre et al. | 60/748 |
| 4,549,402 | A | 10/1985 | Saintsbury et al. | |
| 5,572,862 | A | 11/1996 | Mowill | |
| 5,826,423 | A | 10/1998 | Lockyer et al. | |
| 6,151,899 | A | 11/2000 | Park | |
| 6,360,525 | B1 | 3/2002 | Senior et al. | |
| 6,684,641 | B2 * | 2/2004 | Moriya et al. | 60/737 |
| 6,786,430 | B2 * | 9/2004 | Hayashi | 60/748 |
| 6,871,488 | B2 | 3/2005 | Oskooei et al. | |
| 6,883,730 | B2 * | 4/2005 | Eberspach et al. | 60/737 |
| 6,901,756 | B2 * | 6/2005 | Gerendas et al. | 60/740 |
| 6,908,303 | B1 | 6/2005 | Oda et al. | |
| 7,237,730 | B2 | 7/2007 | Prociw et al. | |
| 7,251,940 | B2 | 8/2007 | Graves et al. | |
| 7,434,401 | B2 * | 10/2008 | Hayashi | 60/743 |
| 2005/0039456 | A1 * | 2/2005 | Hayashi | 60/737 |
| 2009/0301092 | A1 * | 12/2009 | Wilbraham | 60/748 |

FOREIGN PATENT DOCUMENTS

| | | | | |
|---|---|---|---|---|
| GB | 2444737 | A * | 6/2008 | 60/748 |

OTHER PUBLICATIONS

Brandt, D.E. and Wesorick, R.R., GER-3434D: GE Gas Turbine Design Philosophy, GE Industrial & Power Systems, Schenectady, NY, Sep. 1994.*

* cited by examiner

*Primary Examiner* — Ehud Gartenberg
*Assistant Examiner* — Lorne Meade
(74) *Attorney, Agent, or Firm* — Carlson, Gaskey & Olds PC

(57) ABSTRACT

An air-blast fuel nozzle assembly includes a housing having an inner surface defining an interior chamber around a central axis. The inner surface terminates in an exit aperture. An air swirler pneumatically communicates with the interior chamber and has vanes operative to impart a swirling motion to air passing across the vanes and into the interior chamber. A fuel injection assembly includes a nozzle portion extending along the central axis and having a plurality of outlets circumferentially-arranged around the central axis that are directed into the interior chamber toward the inner surface of the housing. A shield extends radially outwardly from the nozzle portion upstream of the plurality of outlets. The shield extends between a base at the nozzle section and a free tip end such that the shield extends partially across the interior chamber toward the inner surface.

11 Claims, 3 Drawing Sheets

AIR-BLAST FUEL-INJECTOR WITH SHIELD-CONE UPSTREAM OF FUEL ORIFICES

STATEMENT REGARDING FEDERALLY SPONSORED RESEARCH AND DEVELOPMENT

The U.S. Government may have an interest in the subject matter of this disclosure as provided for by the terms of contract number N00019-02-C-3003 awarded by the United States Navy.

BACKGROUND

1. Technical Field

The disclosure generally relates to gas turbine engines.

2. Description of the Related Art

Gas turbine engines typically incorporate combustions sections in which fuel and air are mixed and combusted. Efficiency of combustion is related to a variety of factors including fuel-to-air ratio, ignition source location and degree of fuel atomization, among a host of others. Notably, some combustion sections use flows of air to atomize fuel after the fuel has been sprayed from fuel nozzles.

SUMMARY

Systems and methods involving improved fuel atomization in air-blast fuel nozzles of gas turbine engines are provided. In this regard, an exemplary embodiment of an air-blast fuel nozzle assembly comprises: a housing having an inner surface defining an interior chamber, the inner surface terminating in an exit aperture; an air swirler pneumatically communicating with the interior chamber, the air swirler having vanes operative to impart a swirling motion to air passing across the vanes and into the interior chamber; and a fuel injection assembly operative to spray fuel within the interior chamber such that at least some of the fuel provided to the fuel nozzle assembly impinges upon the inner surface of the housing and films to promote atomization of the fuel regardless of an operative fuel flow rate of the fuel provided; at least some of the fuel being atomized by the air swirling through the interior chamber, with a remainder of the fuel atomizing based on interaction with the inner surface of the housing.

An exemplary embodiment of a combustion assembly for a gas turbine engine comprises: a fuel nozzle assembly having a housing and a fuel injection assembly; the housing having an inner surface defining an interior chamber, the inner surface terminating in an exit aperture; the fuel injection assembly being operative to spray fuel within the interior chamber such that at least some of the fuel provided to the fuel nozzle assembly impinges upon the inner surface of the housing and films to promote atomization of the fuel regardless of an operative fuel flow rate of the fuel provided.

An exemplary embodiment of a method for atomizing fuel in a gas turbine engine comprises: providing fuel to a chamber defined by an inner surface; and continuously atomizing at least a portion of the fuel via interaction of the fuel with the inner surface.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Systems and methods involving improved fuel atomization in air-blast fuel nozzles of gas turbine engines are provided, several exemplary embodiments of which will be described in detail. In this regard, enhanced atomization of fuel of air-blast fuel nozzles appears to be present when fuel is able to film (i.e., impinge on a surface to form sheets of fuel) along the inner surfaces of chambers of the fuel nozzle assemblies. In an exemplary embodiment, fuel is injected toward the inner surface by the orientation of the fuel injectors such that fuel impinges and intersects the inner surface and produces a fuel film. In some embodiments, fuel is directed to film along the inner surfaces by being dispensed adjacent to the inner surfaces. This is in contrast to conventional fuel nozzles that typically allow the fuel to be entrained by air passing through the nozzles before that fuel is able to contact the inner surfaces of the nozzle assembly chambers. Additionally or alternatively, some embodiments can enable fuel to film along the inner surfaces by inhibiting the ability of air passing through the chambers from entraining the fuel prior to the fuel contacting the inner surfaces. In some embodiments, this is accomplished by using a shield that diverts the air.

Figure 1:
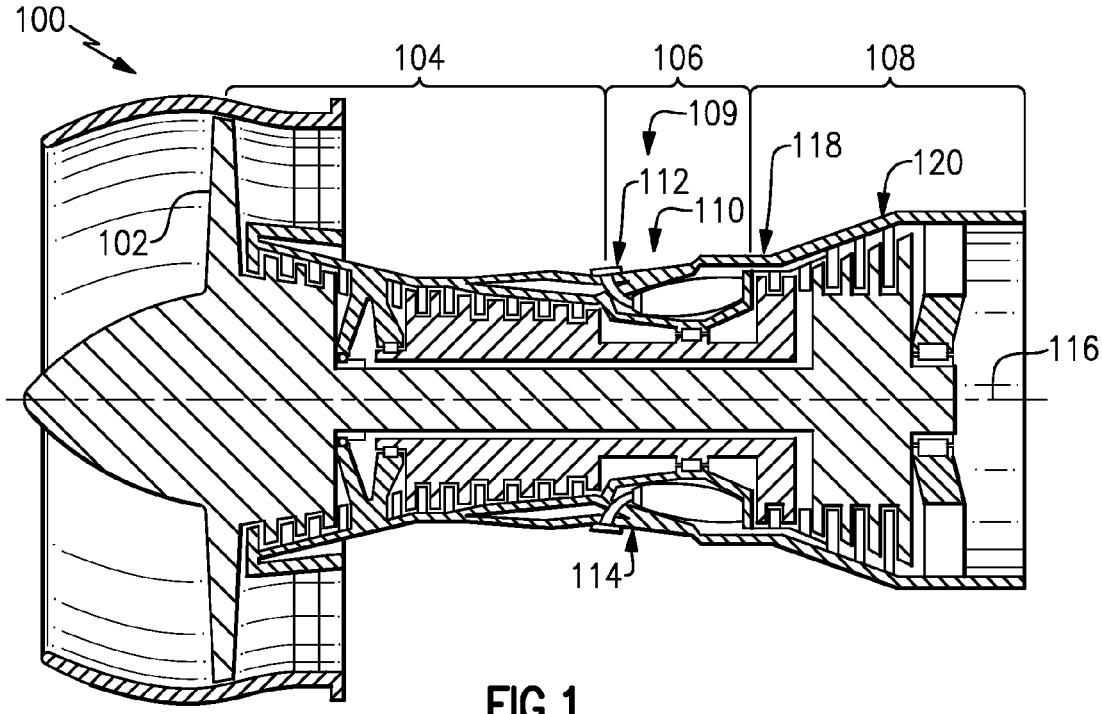
FIG.1 Prior Art
FIG. 1 is a schematic diagram depicting an exemplary embodiment of a gas turbine engine.

Reference is now made to the schematic diagram of FIG. 1, which depicts an exemplary embodiment of a gas turbine engine. As shown in FIG. 1, engine 100 is depicted as a turbofan that incorporates a fan 102, a compressor section 104, a combustion section 106 and a turbine section 108. Although depicted as a turbofan gas turbine engine, it should be understood that the concepts described herein are not limited to use with turbofans as the teachings may be applied to other types of gas turbine engines.

Combustion section 106 incorporates a combustion assembly 109 that includes a main burner 110. The main burner includes an array of fuel nozzle assemblies (e.g., assemblies 112, 114) that are positioned annularly about a centerline 116 of the engine upstream of turbines 118 and 120. The fuel nozzle assemblies provide fuel to one or more chambers for mixing and/or ignition. It should be noted that, although the concept is described herein with respect to a main burner, various embodiments may additionally or alternatively incorporate the concept in an afterburner configuration.

Figure 2:
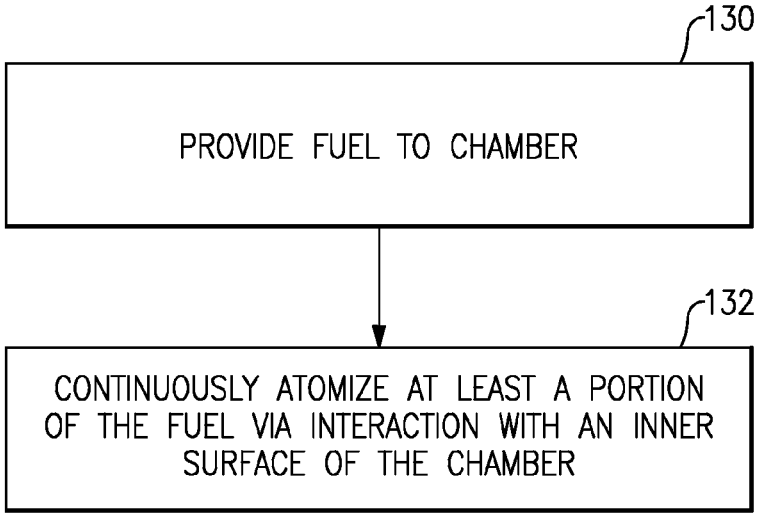
FIG. 2 is a flowchart depicting a method for atomizing fuel in a gas turbine engine, such as may be performed by the embodiment of FIG. 1.

FIG. 2 is a flowchart depicting a method for atomizing fuel in a gas turbine engine, such as may be performed by engine 100. As shown in FIG. 2, the method involves providing fuel to a chamber (block 130) using fuel injectors. Then, as depicted in block 132, at least a portion of the fuel provided to the chamber is continuously atomized via interaction with the inner surface of the chamber. As mentioned before, enabling the fuel to film along the inner surface of a fuel nozzle chamber can enhance atomization and combustion performance. This is typically caused by the film of fuel being sheared by air passing through the chamber as the fuel departs the inner surface at the downstream or exit end of the chamber. The thin film of fuel breaks up into small droplets because of the shear and instability in the film, thereby producing fine droplets as the fuel departs the inner surface. Without this filming enhancement, the fuel break-up can take a relatively long time and/or occur over a relatively long distance, with relatively large droplets of fuel being produced that can degrade combustion performance.

Figure 3:
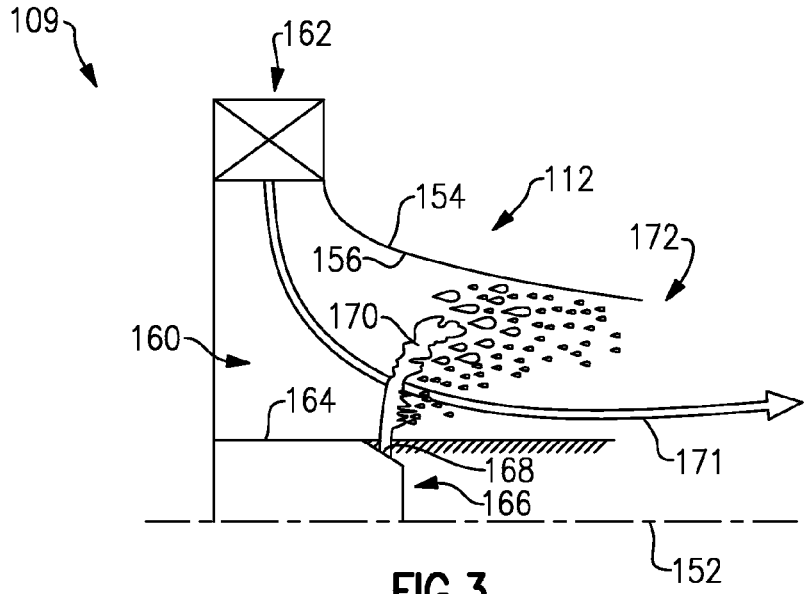
FIG. 3 is a schematic diagram depicting an embodiment of a fuel nozzle assembly.

FIG. 3 is a schematic diagram depicting an embodiment of a fuel nozzle assembly. In particular, FIG. 3 depicts the combustion assembly 109 including a portion of fuel nozzle assembly 112, which exhibits axial symmetry about axis 152. Fuel nozzle assembly 112 includes a housing 154, the inner surface 156 of which defines a chamber 160. An air swirler 162, which includes an annular arrangement of vanes and a downstream nozzle portion 164, pneumatically communicates with the chamber. A fuel injection assembly 166 also is provided that includes a fuel outlet 168. The fuel injection assembly sprays liquid fuel 170 within the chamber via the outlet 168 during operation. Simultaneously, the vanes of the air swirler impart an axial velocity to air entering the air swirler. The axial velocity imparted causes the air to swirl as the air (171) travels through the chamber and out the downstream exit end 172 of the chamber. Typically, the fuel nozzle assembly is designed so that at least some of the fuel (e.g., a majority of the fuel) penetrates across the chamber and impinges upon the inner surface of the housing to create a fuel film. However, at relatively low fuel flow settings and/or relatively high air flow velocities, penetration may be reduced (i.e., the air may tend to entrain much of the fuel before the fuel is able to film along the inner surface of the housing). Unfortunately, a reduced ability to film can result in less than desirable atomization of the fuel, which can lead to less efficient combustion.

Figure 4:
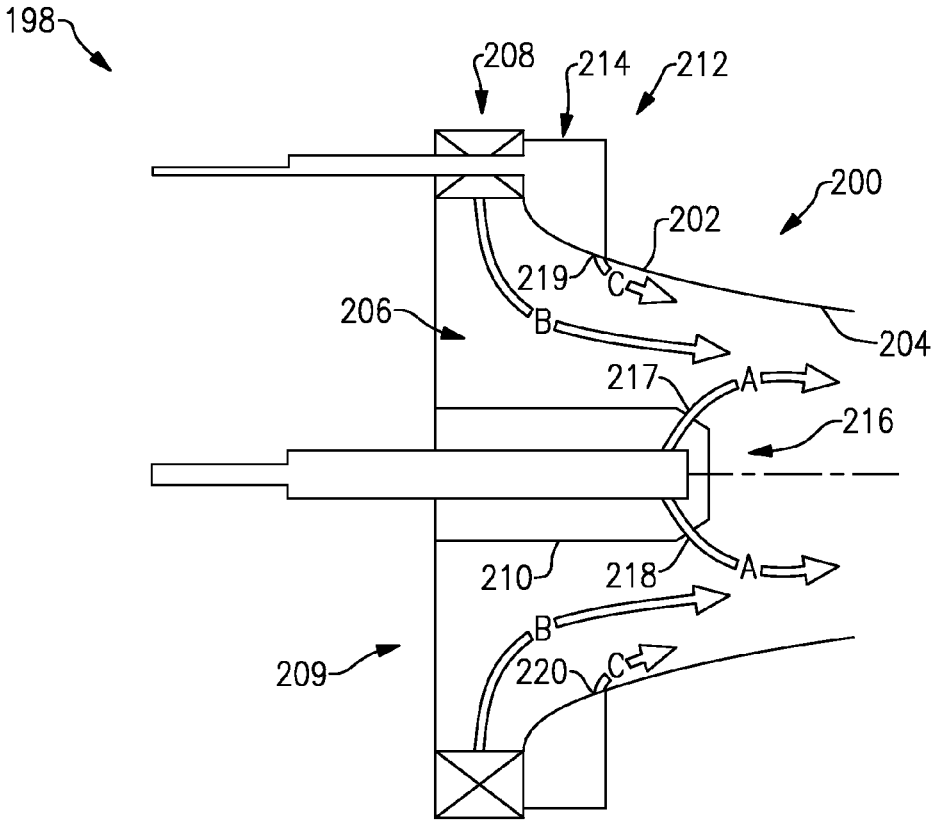
FIG. 4 is a schematic diagram depicting another embodiment of a fuel nozzle assembly.

In this regard, an exemplary embodiment of a fuel nozzle assembly is depicted in FIG. 4 that may be able to facilitate fuel filming regardless of an operative fuel flow rate and/or air velocity associated with the assembly. As shown in FIG. 4, a combustion assembly 198 includes a fuel nozzle assembly 200. The fuel nozzle assembly 200 includes a housing 202, the inner surface 204 of which defines a chamber 206. An air swirler 208, located at an upstream end 209 of the assembly, includes an annular arrangement of vanes and a downstream nozzle portion 210.

Fuel nozzle assembly 200 also incorporates a fuel injection assembly 212 that includes a direct fuel filmer 214 and a fuel injector 216. Fuel injector 216 sprays liquid fuel (depicted by arrows A) within chamber 206 via a series of outlets (e.g., outlets 217, 218). At least some of the fuel output through the outlets is entrained by air (depicted by arrows B) passing through the chamber. Under some conditions, at least some of the fuel may impinge upon the inner surface 204 prior to being entrained.

Direct fuel filmer 214 delivers liquid fuel (depicted by arrows C) within chamber 206. Specifically, direct fuel filmer 214 directs fuel from a series of fuel ports (e.g., ports 219, 220) that are located adjacent to the inner surface of the housing. As such, fuel provided from the fuel ports of the direct fuel filmer contacts the inner surface of the housing prior to being entrained by air passing through the interior chamber. The secondary source of fuel provided by the direct fuel filmer 214 ensures proper fuel filming on the inner surface 204 regardless of the total fuel flow provided to the fuel nozzle in this embodiment. Separate control of the fuel to the fuel ports of the direct fuel filmer and the outlets of the fuel injector can be used to provide enhanced fuel filming over a range of total fuel flow rates.

Figure 5:
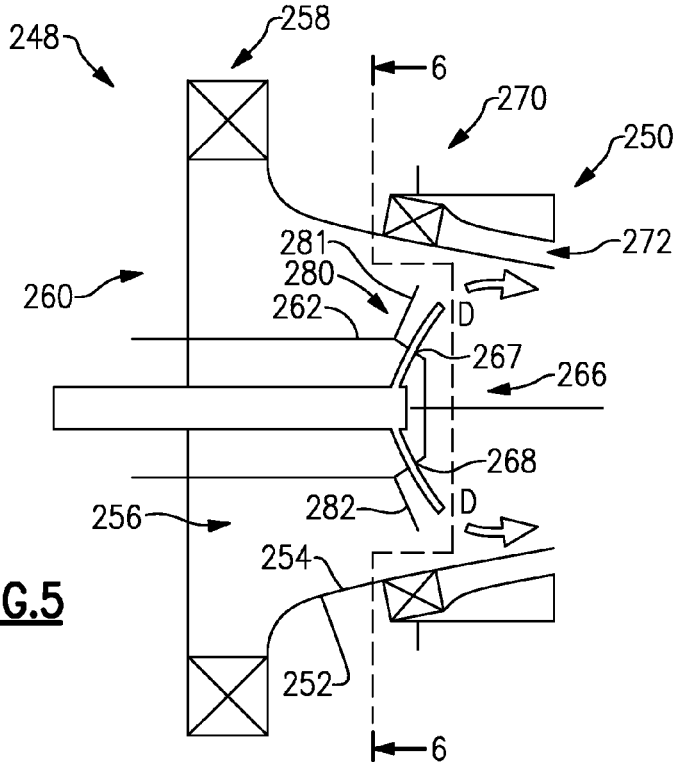
FIG. 5 is a schematic diagram depicting another embodiment of a fuel nozzle assembly.
Figure 6:
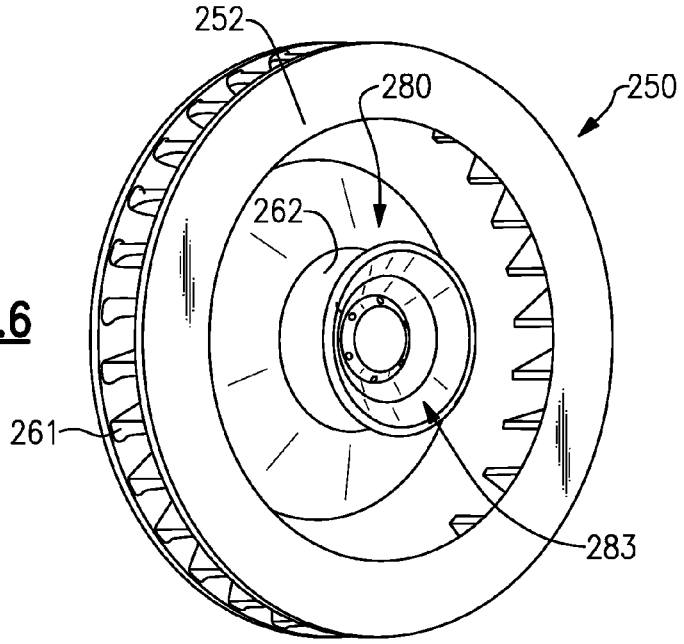
FIG. 6 is a partial cut-away depicting the embodiment of FIG. 5 to show detail of the shield.

Another exemplary embodiment of a fuel nozzle assembly is depicted in FIGS. 5 and 6. As shown, a combustion assembly 248 includes a fuel nozzle assembly 250. The fuel nozzle assembly 250 includes a housing 252, the inner surface 254 of which defines a chamber 256. A primary air swirler 258, located at an upstream end 260 of the assembly, includes an annular arrangement of vanes (e.g., vane 261) and a downstream nozzle portion 262. A fuel injection assembly that includes a fuel injector 266 (removed in FIG. 6) is oriented along a centerline of the nozzle portion. Fuel injector 266 sprays liquid fuel (depicted by arrows D) within chamber 256 via a series of outlets (e.g., outlets 267, 268). A secondary air swirler 270 (optional on this and other embodiments) also is provided, the outlet 272 of which is located downstream of the fuel injector.

In order to ensure that at least some (e.g., a majority) of the fuel provided to the fuel nozzle assembly reaches the inner surface 254, a shield 280 is provided. Shield 280 inhibits air passing through chamber 256 from entraining all of the fuel sprayed within the interior chamber prior to at least some of that fuel impinging upon the inner surface 254 of the housing. In this embodiment, the shield 280 includes an annular array of protrusions (e.g., protrusions 281, 282) that extend outwardly from the fuel injector.

As shown more clearly in FIG. 6, each of the protrusions is generally rectangular in shape and is inclined with respect to the centerline to exhibit a downstream inclination from root to tip. In this embodiment, each fuel outlet of the injector has a corresponding protrusion located upstream there from. In other embodiments, a one-to-one correspondence between protrusions and fuel outlets need not be present.

Widths, lengths, shapes, orientations and numbers of protrusions and spacing between adjacent protrusions can vary between embodiments. Notably, thinner protrusions can offer less flow blockage and pressure loss compared to thicker protrusions of similar number and orientation. In contrast, thicker protrusions (even to the extent of a continuous protruding lip 283) potentially offer more shielding of the fuel injector outlets and, thus, may enable more fuel to reach the inner surface 254.

In this embodiment, the fuel injector is configured as a removable assembly. Specifically, shield 280 is integrated with the nozzle portion 262 of the primary air swirler so that the fuel injector 266 can be removed, such as for servicing.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. By way of example, some embodiments can incorporate the use of shields and fuel filmers in order to ensure an adequate amount of fuel is available for filming. By way of further example, although the concepts described herein have been presented with respect to engines that lack augmentation (afterburners), the teachings may be applied to gas turbine engines that include augmentation. For instance, in such an engine, the augmentors can incorporate nozzle assemblies that are provisioned for enhancing the degree of fuel filming that occurs. All such modifications and variations are intended to be included herein within the scope of this disclosure and protected by the accompanying claims.

The invention claimed is:

1. An air-blast fuel nozzle assembly comprising:

a housing having an inner surface defining an interior chamber around a central axis, the inner surface terminating in an exit aperture;

an air swirler pneumatically communicating with the interior chamber, the air swirler having vanes operative to impart a swirling motion to air passing across the vanes and into the interior chamber;

a fuel injection assembly including a nozzle portion extending along the central axis and having a plurality of outlets circumferentially-arranged around the central axis that are directed into the interior chamber toward the inner surface of the housing; and a shield extending circumferentially and continuously around the central axis and extending radially outwardly from the nozzle portion upstream of the plurality of outlets, the shield extending between a base at the nozzle portion and a free lip end such that the shield extends partially across the interior chamber toward the inner surface.

2. The air-blast fuel nozzle assembly of claim 1, wherein:

the fuel injection assembly has a direct fuel filmer;

the direct fuel filmer has a fuel port located adjacent to the inner surface of the housing; and the direct fuel filmer is operative to expel fuel from the fuel port such that the fuel contacts the inner surface of the housing prior to being entrained by air passing through the interior chamber.

3. The air-blast fuel nozzle assembly of claim 2, wherein the fuel injection assembly has a fuel injector in the nozzle portion operative to provide a spray of fuel within the interior chamber.

4. The air-blast fuel nozzle assembly of claim 1, wherein the shield is located radially inwards of the vanes of the air swirler.

5. The air-blast fuel nozzle assembly of claim 1, wherein the shield is arranged downstream from the vanes of the air swirler.

6. A combustion assembly for a gas turbine engine comprising:

a fuel nozzle assembly having a housing and a fuel injection assembly;

the housing having an inner surface defining an interior chamber, the inner surface terminating in an exit aperture;

the fuel injection assembly including a nozzle portion having a plurality of outlets circumferentially-arranged around a central axis of the nozzle portion and directed toward the inner surface of the housing; and a shield extending circumferentially and continuously around the central axis and extending radially outwardly from the nozzle portion adjacent the plurality of outlets, the shield extending between a base at the nozzle portion and a free lip end such that the shield extends partially across the interior chamber toward the inner surface.

7. The combustion assembly of claim 6, wherein:

the assembly further comprises an air swirler pneumatically communicating with the interior chamber;

the air swirler has vanes operative to impart a swirling motion to air passing across the vanes and into the interior chamber; and in operation, at least some of the fuel is atomized by the air swirling through the interior chamber, with a remainder of the fuel being atomized based on interaction with the inner surface of the housing.

8. The combustion assembly of claim 6, wherein the combustion assembly is a main burner combustion assembly.

9. The combustion assembly of claim 6, wherein: the fuel nozzle assembly is a first fuel nozzle assembly; and the assembly comprises multiple fuel nozzle assemblies.

10. The combustion assembly of claim 6, wherein:

the fuel injection assembly has a direct fuel filmer;

the direct fuel filmer has a fuel port located adjacent to the inner surface of the housing; and the direct fuel filmer is operative to expel fuel from the fuel port such that the fuel contacts the inner surface of the housing prior to being entrained by air passing through the interior chamber.

11. The combustion assembly of claim 6, wherein the shield has a uniform cross-sectional area between the base and the free lip end.

* * * * *